US005932535A

United States Patent [19]

Neuss et al.

[11] Patent Number: 5,932,535

[45] Date of Patent: Aug. 3, 1999

[54] PROCESS FOR THE PRODUCTION OF LIGHT-COLORED, LOW-VISCOSITY SURFACTANT CONCENTRATES

[75] Inventors: Michael Neuss, Cologne; Karl Heinz Schmid, Mettmann; Andrea Borntraeger, Haan, all of Germany

[73] Assignee: Henkel Kommanditgesellschaft auf Aktien, Duesseldorf, Germany

[21] Appl. No.: 08/768,155

[22] Filed: Dec. 17, 1996

Related U.S. Application Data

[60] Provisional application No. 60/024,205, Aug. 20, 1996.

[30] Foreign Application Priority Data

Dec. 21, 1995 [DE] Germany ..... 195 48 068

[51] Int. Cl.[6] ..... C11D 11/00; C11D 1/94; C11D 3/22; C11D 17/00

[52] U.S. Cl. ..... 510/535; 510/470; 510/490; 510/502

[58] Field of Search ..... 510/470, 535, 510/536, 537, 490, 502, 433; 252/FOR 239, FOR 198, FOR 200

[56] References Cited

U.S. PATENT DOCUMENTS

| | | | |
|---|---|---|---|
| 1,985,424 | 12/1934 | Piggott | 260/124 |
| 2,016,962 | 10/1935 | Flint et al. | 260/127 |
| 2,703,798 | 3/1955 | Schwartz | 260/211 |
| 4,536,317 | 8/1985 | Llenado et al. | 510/444 |
| 4,536,318 | 8/1985 | Cook et al. | 510/424 |
| 4,565,647 | 1/1986 | Llenado | 252/534 |
| 4,599,188 | 7/1986 | Llenado | 510/423 |
| 4,663,069 | 5/1987 | Llenado | 510/126 |
| 4,668,422 | 5/1987 | Malik et al. | 252/174.17 |
| 5,374,716 | 12/1994 | Biermann et al. | 536/18.6 |
| 5,443,817 | 8/1995 | Zimmerman et al. | 424/47 |
| 5,464,874 | 11/1995 | Balzer | 514/777 |
| 5,503,779 | 4/1996 | Adamy et al. | 510/427 |
| 5,529,721 | 6/1996 | Salka et al. | 510/123 |
| 5,578,560 | 11/1996 | Giesen et al. | 510/237 |
| 5,646,100 | 7/1997 | Haugk et al. | 510/131 |
| 5,670,471 | 9/1997 | Amalric et al. | 510/416 |
| 5,686,400 | 11/1997 | Urfer et al. | 510/237 |

FOREIGN PATENT DOCUMENTS

| | | |
|---|---|---|
| 075 994 | 4/1983 | European Pat. Off. . |
| 250 181 | 12/1987 | European Pat. Off. . |
| 285 768 | 10/1988 | European Pat. Off. . |
| 301 298 | 2/1989 | European Pat. Off. . |
| 341 071 | 11/1989 | European Pat. Off. . |
| 453 238 | 10/1991 | European Pat. Off. . |
| 508 507 | 10/1992 | European Pat. Off. . |
| 513 138 | 11/1992 | European Pat. Off. . |
| 1 580 491 | 9/1969 | France . |
| 42 34 487 | 4/1994 | Germany . |
| 42 36 958 | 8/1994 | Germany . |
| 43 09 567 | 9/1994 | Germany . |
| 43 11 114 | 10/1994 | Germany . |
| 44 00 632 | 3/1995 | Germany . |
| WO 90/03977 | 4/1990 | WIPO . |
| WO 91/11506 | 8/1991 | WIPO . |
| WO 92/06152 | 4/1992 | WIPO . |
| WO 92/06153 | 4/1992 | WIPO . |
| WO 92/06154 | 4/1992 | WIPO . |
| WO 92/06155 | 4/1992 | WIPO . |
| WO 92/06156 | 4/1992 | WIPO . |
| WO 92/06157 | 4/1992 | WIPO . |
| WO 92/06158 | 4/1992 | WIPO . |
| WO 92/06159 | 4/1992 | WIPO . |
| WO 92/06160 | 4/1992 | WIPO . |
| WO 92/06161 | 4/1992 | WIPO . |
| WO 92/06162 | 4/1992 | WIPO . |
| WO 92/06164 | 4/1992 | WIPO . |
| WO 92/06170 | 4/1992 | WIPO . |
| WO 92/06171 | 4/1992 | WIPO . |
| WO 92/06172 | 4/1992 | WIPO . |
| WO 92/06984 | 4/1992 | WIPO . |

OTHER PUBLICATIONS

English translation of WO 95/04592, published Feb. 16, 1995 (LeCocu–Michel et al.).
Derwent Abstract accession No. 95–090724, for WO 9504592, published Feb. 16, 1995, 1997.
Skin Care Forum, Oct. 1992.
Seifen–Öle–Fette–Wachse 118, 1992, p. 894.
Seifen–Öle–Fette–Wachse 118, 1992, p. 905.
Rivista Italiana 56, 1974, p. 567.
Tens. Surf. Det. 25 (1988) p. 8.
Seifen–Öle–Fette–Wachse, 198, 1982, p. 373.
HAPPI, Nov. (1986) p. 70.
Tens. Det. 23, 1986, p. 309.
Soap Cosm. Chem. Spec., Apr. 1990, p. 46.
Euro Cosm. 1, 1994, p. 14

*Primary Examiner*—Ardith Hertzog
*Attorney, Agent, or Firm*—Wayne C. Jaeschke; John E. Drach; Steven J. Trzaska

[57] ABSTRACT

Light-colored, low-viscosity surfactant concentrates, are made by mixing: mixing: (a) a sugar surfactant selected from the group consisting of an alkyl and/or alkenyl oligoglycoside, a fatty acid-N-alkyl polyhydroxyalkylamide and a combination thereof and, (b) a betaine in a ratio by weight of (a) to (b) of from about 90:10 to about 10:90, with the proviso that components (a) and (b)are present in the gel phase.

7 Claims, No Drawings

PROCESS FOR THE PRODUCTION OF LIGHT-COLORED, LOW-VISCOSITY SURFACTANT CONCENTRATES

BENEFIT OF EARLIER FILING DATE UNDER 37 CFR 1.78(A) (4)

This application claims the benefit of earlier filed and copending provisional application Ser. No. 60/024,205 filed on Aug. 20, 1996.

BACKGROUND OF THE INVENTION

1. Field of the Invention

This invention relates to a process for the production of light-colored, low-viscosity surfactant concentrates by mixing sugar surfactants and betaines in the gel phase.

2. Description of the Related Art

Alkyl oligoglycosides, more particularly alkyl oligoglucosides, are nonionic surfactants which are acquiring increasing significance by virtue of their excellent detergent properties and their high ecotoxicological compatibility. The production and use of these substances have been described just recently in a number of synoptic articles of which those by H. Hensen in Skin Care Forum, (October 1992), D. Balzer and N. Ripke in Seifen-Öle-Fette-Wachse 118, 894 (1992) and B. Brancq in Seifen-Öle-Fette-Wachse 118, 905 (1992) are cited as representative. Equally favorable properties are known to be exhibited by a second group of sugar surfactants, namely fatty acid-N-alkyl polyhydroxyalkylamides, more particularly fatty acid-N-alkyl glucamides.

In some respects, however, the use of sugar surfactants is attended by problems. For example, it is not possible to produce pumpable aqueous concentrates with a solids content above 40% by weight without the sugar component undergoing partial decomposition in the course of the concentration process. In addition, the glycosides and glucamides share this property with most anionic surfactants which form a viscous gel phase above an active substance content of around 35% by weight. In addition, sugar surfactants have a tendency to crystallize during storage at low temperatures which is a significant obstacle to their subsequent use.

The use of sugar surfactants of the types mentioned above together with amphoteric or zwitterionic surfactants of the betaine type in surface-active formulations is known in principle from the prior art.

Mixtures of—albeit short-chain—alkyl glucosides and alkyl amidobetaines or imidazolinium betaines were disclosed for the first time in an article by G. Proserpio et al in Rivista Italiana 56, 567 (1974). EP-A 0 075 994 (Procter & Gamble) describes combinations of alkyl glucosides with amine oxides, unsaturated soaps, water-soluble builders and selected anionic surfactants. In addition, the mixtures may contain amphoteric surfactants, for example betaines of the 6-(N-dodecylbenzyl-N,N-dimethylammonium)-hexanoate type. U.S. Pat. No. 4,668,422 (Henkel Corp.) discloses liquid soaps and foam baths containing alkyl glucosides, betaines and amine oxides. EP-A-0 250 181 (Helene Curtis) relates to liquid detergents containing alkyl glucosides, anionic surfactants and selected amphoteric surfactants of betaine structure. Surfactant combinations containing alkyl glucosides, alkyl sulfates, betaines and/or amine oxides and optionally alkanolamides are disclosed in EP-A 0 341 071 (Unilever). Manual dishwashing detergents containing alkyl glucosides, fatty alcohol sulfates, fatty alcohol ether sulfates and betaines are known from EP-A 0 513 138, DE-A1 42 34 487 and DE-A1 43 11 114 (all Henkel). Mild shampoos based on alkyl glucosides, anionic surfactants and betaines are described in EP-A 0 453 238 (Unilever). Finally, EP-A 0 508 507 (Berol Nobel) relates to liquid detergents containing alkyl glucosides, anionic surfactants and selected amphoteric surfactants of betaine structure. However, all these publications are concerned with dilute water-containing surfactant mixtures or formulations and not with concentrates.

The use of fatty acid-N-alkyl polyhydroxyalkylamides is also the subject of a number of publications. For example, their use as thickeners is known from European patent application EP-A1 0 285 768 (Hüls). FR-A 1 580 491 (Henkel) describes water-containing detergent mixtures based on sulfates and/or sulfonates, nonionic surfactants and optionally soaps which contain fatty acid-N-alkyl glucamides as foam regulators. Mixtures of short-chain and relatively long-chain glucamides are described in DE-C1 44 00 632 (Henkel). In addition, DE-A1 42 36 958 and DE-A1 43 09 567 (Henkel) report on the use of glucamides containing relatively long alkyl chains as pseudoceramides in skin-care formulations and on combinations of glucamides with protein hydrolyzates and cationic surfactants in hair-care products.

International patent application WO 92/06153; WO 92/06156; WO 92/06157; WO 92/06158; WO 92/06159 and WO 92/06160 (Procter & Gamble) relate to mixtures of fatty acid-N-alkyl glucamides with anionic surfactants, sulfate and/or sulfonate surfactants, ether carboxylic acids, ether sulfates, methyl ester sulfonates and nonionic surfactants. The use of these substances in various laundry detergents, dishwashing detergents and cleaning formulations is described in international patent applications, WO 92/06152; WO 92/06154; WO 92/06155; WO 92/06161; WO 92/06162, WO 92/06164, WO 92/06170, WO 92/06171 and WO 92/06172 (Procter & Gamble).

There is a need on the market for concentrated surfactant mixtures based on alkyl and/or alkenyl oligoglucosides which are flowable and pumpable despite a solids content of more than 30% by weight and preferably of the order of 50 to 60% by weight and which have a significantly reduced tendency to crystallize, i.e. improved stability in storage. Since surfactant compounds of the type in question are mainly used in manual dishwashing detergents and hair shampoos, skin-cosmetic or rather dermatological compatibility is also extremely important.

Surfactant concentrates are a particularly favorable commercial formulation for manufacturers and users because they have been minimized in terms of their water content and hence incur lower transport and storage costs. Nevertheless, it is desirable that the surfactant concentrates should have a sufficiently high viscosity in the final formulations, which are of course heavily diluted and have a solids content of 20 to 30% by weight, and should readily lend themselves to thickening using known additives.

Accordingly, the complex problem addressed by the present invention was to provide light-colored, pumpable water-containing surfactant concentrates with high dermatological compatibility based on alkyl glycosides or fatty acid glucamides and betaines which would be distinguished by high stability in storage and which would have a Brookfield viscosity of at most 10,000 mPa·s and a solids content of 40 to 60% by weight.

DESCRIPTION OF THE INVENTION

The present invention relates to a process for the production of light-colored, low-viscosity surfactant concentrates in which (a1) alkyl and/or alkenyl oligoglycosides and/or (a2) fatty acid-N-alkyl polyhydroxyalkylamides and (b) betaine surfactants are mixed in a ratio by weight of (a) to (b) of 90:10 to 10:90, with the proviso that the starting materials are present in the gel phase.

It has surprisingly been found that it is not necessary for the production of the required concentrates to start out from low-viscosity, i.e. dilute, water-containing starting materials and to concentrate them in a subsequent step. On the contrary, it has been found that the mixing of concentrated starting materials which are present in the gel phase and which, therefore, are not themselves low in viscosity results in the formation of products which are low in viscosity, light-colored and stable in storage.

Alkyl and/or alkenyl oligoglycosides

Alkyl and alkenyl oligoglycosides are known nonionic surfactants corresponding to formula (I):

$$R^1O\text{-}[G]_p \qquad (I)$$

in which $R^1$ is an alkyl and/or alkenyl radical containing 4 to 22 carbon atoms, G is a sugar unit containing 5 or 6 carbon atoms and p is a number of 1 to 10. They may be obtained by the relevant methods of preparative organic chemistry. EP-A1 0 301 298 and WO 90/03977 are cited as representative of the extensive literature available on the subject.

The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides.

The index p in general formula (I) indicates the degree of oligomerization (DP degree), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view.

The alkyl or alkenyl radical $R^1$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl radical $R^1$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut oil fatty alcohol having a DP of 1 to 3 are preferred.

Fatty acid-N-alkyl polyhydroxyalkylamides

Fatty acid-N-alkyl polyhydroxyalkylamides are nonionic surfactants which correspond to formula (II):

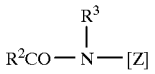

(II)

in which $R^2CO$ is an aliphatic acyl radical containing 6 to 22 carbon atoms, $R^3$ is hydrogen, an alkyl or hydroxyalkyl radical containing 1 to 4 carbon atoms and [Z] is a linear or branched polyhydroxyalkyl radical containing 3 to 12 carbon atoms and 3 to 10 hydroxyl groups.

Fatty acid-N-alkyl polyhydroxyalkylamides are known compounds which may normally be obtained by reductive amination of a reducing sugar with ammonia, an alkylamine or an alkanolamine and subsequent acylation with a fatty acid, a fatty acid alkyl ester or a fatty acid chloride. Processes for their production are described in U.S. Pat. No. 1,985,424, in U.S. Pat. No. 2,016,962 and in U.S. Pat. No. 2,703,798 and in international patent application WO 92/06984. An overview of this subject by H. Kelkenberg can be found in Tens. Surf. Det. 25, 8 (1988).

The fatty acid-N-alkyl polyhydroxyalkylamides are preferably derived from reducing sugars containing 5 or 6 carbon atoms, more particularly from glucose. Accordingly, the preferred fatty acid-N-alkyl polyhydroxyalkylamides are fatty acid-N-alkyl glucamides which correspond to formula (III):

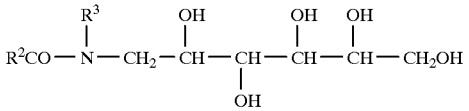

(III)

Preferred fatty acid-N-alkyl polyhydroxyalkylamides are glucamides corresponding to formula (III) in which $R^3$ is hydrogen or an alkyl group and $R^2CO$ represents the acyl component of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid or erucic acid or technical mixtures thereof. Fatty acid N-alkyl glucamides (III) obtained by reductive amination of glucose with methylamine and subsequent acylation with lauric acid or $C_{12/14}$ coconut oil fatty acid or a corresponding derivative are particularly preferred. In addition, the polyhydroxyalkylamides may also be derived from maltose and palatinose.

Betaine surfactants

Betaines are known surfactants which are largely produced by carboxyalkylation, preferably carboxymethylation, of aminic compounds. The starting materials are preferably condensed with halocarboxylic acids or salts thereof, more particularly sodium chloroacetate, 1 mole of salt being formed per mole of betaine. The addition of unsaturated carboxylic acids, such as acrylic acid for example, is also possible. Information on nomenclature and, in particular, on the difference between betaines and "true" amphoteric surfactants can be found in the article by U. Ploog in Seifen-Öle-Fette-Wachse, 198, (1982) 373. Further overviews on this subject have been published, for example, by A. O'Lennick et al. in HAPPI, November (1986) 70, by S. Holzman et al. in Tens. Det. 23, (1986) 309, by R. Bilbo et al. in Soap Cosm. Chem. Spec. April (1990) 46 and by P. Ellis et al. in Euro Cosm. 1, (1994) 14.

Examples of suitable betaines are the carboxyalkylation products of secondary and, in particular, tertiary amines corresponding to formula (IV):

(IV)

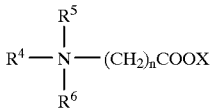

in which $R^4$ represents alkyl and/or alkenyl radicals containing 6 to 22 carbon atoms, $R^5$ represents hydrogen or alkyl radicals containing 1 to 4 carbon atoms, $R^6$ represents alkyl radicals containing 1 to 4 carbon atoms, n is a number of 1 to 6 and X is an alkali metal and/or alkaline earth metal or ammonium.

Typical examples are the carboxymethylation products of hexyl methylamine, hexyl dimethylamine, octyl dimethylamine, decyl dimethylamine, dodecyl methylamine, dodecyl dimethylamine, dodecyl ethyl methylamine, $C_{12/14}$ cocoalkyl dimethylamine, myristyl dimethylamine, cetyl dimethylamine, stearyl dimethylamine, stearyl ethyl methylamine, oleyl dimethylamine, $C_{16/18}$ tallow alkyl dimethylamine and technical mixtures thereof.

Carboxyalkylation products of amidoamines corresponding to formula (V):

(V)

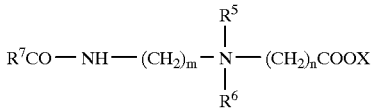

in which $R^7CO$ is an aliphatic acyl radical containing 6 to 22 carbon atoms and 0 or 1 to 3 double bonds, m is a number of 1 to 3 and $R^5$, $R^6$, n and X are as defined above, may also be used.

Typical examples are reaction products of fatty acids containing 6 to 22 carbon atoms, namely caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof, with N,N-dimethylaminoethylamine, N,N-dimethylaminopropylamine, N,N-diethylaminoethylamine and N,N-diethylaminopropylamine which are condensed with sodium chloroacetate. It is preferred to use a condensation product of $C_{8/18}$ coconut oil fatty acid N,N-dimethylaminopropylamide with sodium chloroacetate.

Other suitable starting materials for the betaines to be used in accordance with the invention are imidazolines corresponding to formula (VI):

(VI)

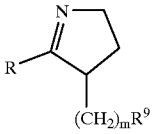

in which $R^8$ is an alkyl radical containing 5 to 21 carbon atoms, $R^9$ is a hydroxyl group, an $OCOR^8$ or $NHCOR^8$ group and m=2 or 3. These compounds are also known compounds which may be obtained, for example, by cyclizing condensation of 1 or 2 moles of fatty acid with polyfunctional amines, such as for example aminoethyl ethanolamine (AEEA) or diethylenetriamine. The corresponding carboxyalkylation products are mixtures of different open-chain betaines.

Typical examples are condensation products of the above-mentioned fatty acids with AEEA, preferably imidazolines based on lauric acid or—again—$C_{12/14}$ coconut oil fatty acid, which are subsequently betainized with sodium chloroacetate.

Surfactant concentrates

The surfactant concentrates are produced from highly concentrated water-containing starting materials present in gel form. This means that the alkyl and/or alkenyl oligoglycosides and/or the fatty acid-N-alkyl polyhydroxyalkylamides are used in the form of aqueous gels with a sugar surfactant content of 45 to 60% by weight and preferably 45 to 55% by weight. The betaine surfactants are generally used with a non-aqueous component of 45 to 60% by weight and preferably 48 to 54% by weight and with a betaine component of 25 to 40% by weight and preferably 28 to 35% by weight. The surfactant concentrates are produced purely mechanically by mixing the gel-form starting materials, optionally at elevated temperatures and with intensive shearing.

In one preferred embodiment of the invention, the betaines are reacted in known manner, for example by reaction of suitable tertiary amines with aqueous sodium chloroacetate solution at around 90° C., and the water-containing glucoside or glucamide pastes are added to the crude betaines without cooling. The betainization is carried out with just that quantity of water as solvent which ensures the required solids content in the mixed product containing the sugar surfactants. In overall terms, this means that the betainization may be carried out with an unusually small quantity of solvent.

Flow promoters

Polyols may be added to the concentrates in small quantities to improve their flowability. Examples of suitable polyols are:

- glycerol;
- alkylene glycols, for example ethylene glycol, diethylene glycol, propylene glycol;
- technical oligoglycerol mixtures with a degree of autocondensation of 1.5 to 10, such as for example technical diglycerol mixtures with a diglycerol content of 40 to 50% by weight;
- methylol compounds, such as in particular trimethylol ethane, trimethylol propane, trimethylol butane, pentaerythritol and dipentaerythritol;
- hydroxycarboxylic acids, for example glycolic acid, tartaric acid and citric acid;
- lower alkyl glucosides, more particularly those containing 1 to 8 carbon atoms in the alkyl radical, such as for example methyl and butyl glucoside;

sugar alcohols containing 5 to 12 carbon atoms, for example sorbitol or mannitol;

sugars containing 5 to 12 carbon atoms, for example glucose or sucrose;

aminosugars, for example glucamine.

Polyols—more particularly glycerol—are added to the concentrates in quantities of preferably 0.5 to 5% by weight and, more preferably, 1 to 3% by weight, based on the concentrates.

The surfactant concentrates may contain small quantities, i.e. 0.5 to 3% by weight and preferably 1 to 2% by weight, based on the concentrates, of free fatty acids as additional flow promoters. Typical examples of such flow promoters are caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and the technical mixtures thereof obtained, for example, in the pressure hydrolysis of natural fats and oils, in the reduction of aldehydes from Roelen's oxosynthesis or in the dimerization of unsaturated fatty acids.

Commercial Applications

The surfactant concentrates according to the invention are distinguished by a low viscosity and yield point. They are light-colored, color-stable and stable in storage. Accordingly, they are suitable for the production of a number of surface-active formulations, for example laundry detergents, dishwashing detergents and cleaning formulations, in which they may be present in quantities of 0.5 to 50% by weight and preferably in quantities of 2 to 35% by weight, based on the particular formulation.

EXAMPLES

The surface-active starting materials listed in Table 1 were used in the following. All percentages are percentages by weight.

TABLE 1

| | Starting materials | | | |
|---|---|---|---|---|
| Composition | Alkyl Oligo-glucoside % | Betaine 1 % | Betaine 2 % | Betaine 3 % |
| Solids content | 51 | 46 | 42 | 40 |
| Surfactant content | 51 | 33 | 36 | 28 |
| Glycerol | — | 3 | — | — |
| Free fatty acid | — | 3 | — | — |
| Consistency (25° C.) | Gel | Gel | Gel | Liquid |
| Color value (Gardner) | 1 | 1 | 1 | 1 |

The surface-active ingredients were mixed at 40° C. to form surfactant concentrates with the composition shown in Table 2 below:

TABLE 2

| | Surfactant concentrates | | |
|---|---|---|---|
| Composition | Example 1 | Example 2 | Example 3 |
| Alkyl oligoglucoside | 50 | 60 | 50 |
| Betaine 1 | 50 | — | — |
| Betaine 2 | — | 40 | — |
| Betaine 3 | — | — | 50 |
| Solids content of the mixture | 54 | 52 | 40 |
| Consistency (25° C.) | Low-viscosity paste | Low-viscosity paste | Low-viscosity paste |
| Color value (Gardner) | 1 | 1 | 1 |

What is claimed is:

1. A process for the production of a light-colored, low-viscosity surfactant concentrate which comprises mixing:

(a) a sugar surfactant selected from the group consisting of an alkyl and/or alkenyl oligoglycoside, a fatty acid-N-alkyl polyhydroxyalkylamide and a combination thereof and, (b) a betaine in a ratio by weight of (a) to (b) of from about 90:10 to about 10:90, with the proviso that component (a) is initially present in the form of a water-containing gel with a sugar surfactant content of from about 45 to about 60% by weight; component (b) is initially present in the form of an aqueous gel with a by-product solids content of 45 to 60% by weight, a betaine solids content of from about 25 to about 40% by weight, and remainder, water.

2. The process of claim 1 wherein said oligoglycoside is a compound of the formula (I):

$$R^1O\text{-}[G]_p \qquad (I)$$

wherein $R^1$ is an alkyl and/or alkenyl radical having from about 4 to about 22 carbon atoms, G is a sugar unit having 5 or 6 carbon atoms and p is a number from 1 to 10.

3. The process of claim 1 wherein said fatty acid-N-alkyl polyhydroxyalkylamide is a compound of the formula (II):

$$R^2CO-\overset{\overset{\displaystyle R^3}{|}}{N}-[Z] \qquad (II)$$

wherein $R^2CO$ is an aliphatic acyl radical having from about 6 to about 22 carbon atoms, $R^3$ is hydrogen, an alkyl or hydroxyalkyl radical having from 1 to 4 carbon atoms and Z is a linear or branched polyhydroxyalkyl radical having from about 3 to about 12 carbon atoms and from about 3 to about 10 hydroxyl groups.

4. The process of claim 1 wherein said betaine is a compound of the formula (IV):

$$R^4-\overset{\overset{\displaystyle R^5}{|}}{\underset{\underset{\displaystyle R^6}{|}}{N}}-(CH_2)_nCOOX \qquad (IV)$$

wherein $R^4$ is an alkyl and/or alkenyl radical having from about 6 to about 22 carbon atoms, $R^5$ is hydrogen or an alkyl radical having from 1 to 4 carbon atoms, $R^6$ is an alkyl radical having from 1 to 4 carbon atoms, n is a number of from 1 to 6 and X is an alkali metal ion and/or alkaline earth metal ion or an ammonium ion.

5. The process of claim 1 wherein said betaine is a compound of the formula (V):

(V)

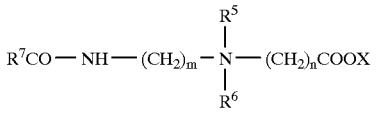

wherein $R^7CO$ is an aliphatic acyl radical having from about 6 to 22 carbon atoms and 0 or 1 to 3 double bonds, m is a number from 1 to 3 $R^5$ is hydrogen or an alkyl radical having from 1 to 4 carbon atoms, $R^6$ is an alkyl radical having from 1 to 4 carbon atoms, n is a number from 1 to 6 and X is an alkali metal ion and/or alkaline earth metal ion or an ammonium ion.

6. The process of claim 1 wherein said concentrate is further comprised of from about 0.5% to about 5% by weight of glycerol.

7. The process of claim 1 wherein said concentrate is further comprised of from about 0.5% to about 3% by weight of a fatty acid.

* * * * *